US008741216B2

(12) United States Patent
Sugimoto et al.

(10) Patent No.: US 8,741,216 B2
(45) Date of Patent: Jun. 3, 2014

(54) STEEL FOR LEAF SPRING WITH HIGH FATIGUE STRENGTH, AND LEAF SPRING PARTS

(75) Inventors: Atsushi Sugimoto, Aichi (JP); Kiyoshi Kurimoto, Kanagawa (JP); Akira Tange, Kanagawa (JP); Yurika Goto, Kanagawa (JP); Mamoru Akeda, Kanagawa (JP)

(73) Assignee: NHK Spring Co., Ltd., Kanagawa (JP)

( * ) Notice: Subject to any disclaimer, the term of this patent is extended or adjusted under 35 U.S.C. 154(b) by 136 days.

(21) Appl. No.: 13/516,568

(22) PCT Filed: Dec. 15, 2010

(86) PCT No.: PCT/JP2010/072541
§ 371 (c)(1),
(2), (4) Date: Jun. 15, 2012

(87) PCT Pub. No.: WO2011/074600
PCT Pub. Date: Jun. 23, 2011

(65) Prior Publication Data

US 2012/0256361 A1 Oct. 11, 2012

(30) Foreign Application Priority Data

Dec. 18, 2009 (JP) ..... 2009-287175

(51) Int. Cl.
*C22C 38/28* (2006.01)
*C22C 38/50* (2006.01)

(52) U.S. Cl.
USPC ..... 420/110; 420/109; 420/126; 148/333; 148/334; 148/335; 148/330; 148/908; 267/166

(58) Field of Classification Search
CPC ..... C22C 38/28; C22C 38/32; C22C 38/50; C22C 38/54; C21D 9/02; C21D 9/52
USPC ..... 420/109, 110, 126; 148/333–335, 330, 148/320, 908, 580; 267/166
See application file for complete search history.

(56) References Cited

U.S. PATENT DOCUMENTS 5,186,768 A * 2/1993 Nomoto et al. ..... 148/580

FOREIGN PATENT DOCUMENTS

| | | | |
|---|---|---|---|
| CN | 101348882 | A | 1/2009 |
| JP | 8 295984 | A | 11/1996 |
| JP | 9 324219 | A | 12/1997 |
| JP | 10 1746 | A | 1/1998 |

(Continued)

OTHER PUBLICATIONS

Notification of Transmittal of the International Preliminary Report on Patentability issued in corresponding International Application No. PCT/JP2010/072541 dated Jul. 19, 2012, 1 page.

(Continued)

*Primary Examiner* — Deborah Yee
(74) *Attorney, Agent, or Firm* — Osha Liang LLP

(57) ABSTRACT

Disclosed is steel for a leaf spring with high fatigue strength containing, in mass percentage, C: 0.40 to 0.54%, Si: 0.40 to 0.90%, Mn: 0.40 to 1.20%, Cr: 0.70 to 1.50%, Ti: 0.070 to 0.150%, B: 0.0005 to 0.0050%, N: 0.0100% or less, and a remainder composed of Fe and impurity elements. Also disclosed is a high fatigue-strength leaf spring part obtained by forming the steel. The steel for a leaf spring is prepared to have a Ti content and a N content to satisfy a relation of Ti/N≥10. Preferably, the leaf spring part is subjected to a shot peening treatment in a temperature range of the room temperature through 400° C. with a bending stress of 650 to 1900 MPa being applied to it.

10 Claims, 8 Drawing Sheets

(56) References Cited

FOREIGN PATENT DOCUMENTS

| | | | |
|---|---|---|---|
| JP | 11 29839 | A | 2/1999 |
| JP | 2002 97551 | A | 4/2002 |
| JP | 2008 266782 | A | 11/2008 |

OTHER PUBLICATIONS

International Preliminary Report on Patentability issued in corresponding International Application No. PCT/JP2010/072541 dated Jul. 10, 2012, 1 page.

English translation of the Written Opinion of the International Search Authority issued in corresponding International Application No. PCT/JP2010/072541 dated Mar. 15, 2011, 3 pages.

International Search Report w/translation for PCT/JP2010/072541 dated Mar. 15, 2011 (2 pages).

Office Action issued in corresponding Chinese Application No. 201080059378.9 dated Dec. 11, 2013, and English translation thereof (10 pages).

* cited by examiner

STEEL FOR LEAF SPRING WITH HIGH FATIGUE STRENGTH, AND LEAF SPRING PARTS

TECHNICAL FIELD

The present invention relates to steel for a leaf spring with high fatigue strength which exhibits excellent fatigue strength stably when used in a leaf spring subjected to a shot peening treatment and which shows excellent toughness and excellent hydrogen embrittlement characteristics while keeping high strength. The present invention also relates to a leaf spring part produced by using the steel.

BACKGROUND ART

As a suspension spring for use in a car, there are used a leaf spring and a spring which is made of a round bar and to which torsion stress is to be applied (a torsion bar, a stabilizer, a coil spring, etc., hereinafter referred to as the spring made of round bar, appropriately). The coil spring is generally used in passenger cars, and the leaf spring is used in trucks. The leaf spring and the spring made of round bar are each one of the large parts in terms of weight among the chassis parts and those parts are continuously researched and developed for higher strength for weight saving conventionally.

To achieve higher strength, it is particularly important to improve fatigue strength, and hardening of the steel is one of the measures for that.

However, as to both of the spring made of round bar and the leaf spring, it is known that if tensile strength is increased by increasing hardness, fatigue strength will be effectively improved in an ordinary environment, while in a corrosive environment, if tensile strength is increased by increasing hardness, fatigue strength will be adversely significantly decreased.

Accordingly, the most significant problem in the conventional developments has been that the countermeasure for improving the tensile strength by simply improving the hardness will not lead to the solution of the problems. Further, although the leaf spring and the spring made of round bar are generally painted when used, there is a possibility that the surface painting of the springs is damaged during driving due to hit by stone, etc., since they are put on cars at a position near the ground, and corrosion may be gradually progressed from the damaged sections, and which may cause breakage in some cases. Still further, a snow melting agent contributing to corrosion is occasionally dispersed on the road in winter to prevent road surface freezing.

For those reasons, there have been strong requirement for development of steel which are hardly lowered in corrosion fatigue strength even if their hardness is improved.

Study has conventionally been conducted in many ways on a decrease in strength, especially, in a decrease in fatigue characteristics in the corrosive environment; in fact a lot of documents etc. have made clear that hydrogen generated as corrosion progresses enters steel and contributes to embrittlement of the steel. As the countermeasures, technologies disclosed in, for example, the following Patent Documents 1 to 3 are reported.

PRIOR ART DOCUMENT

Patent Documents

Patent Document 1: Japanese Patent Application Publication No. 11-29839

Patent Document 2: Japanese Patent Application Publication No. 9-324219

Patent Document 3: Japanese Patent Application Publication No. 10-1746

DISCLOSURE OF THE INVENTION

Problem to be Solved by the Invention

However, the conventional spring steel proposed as hydrogen embrittlement countermeasures is mostly based on the assumption that it would be applied to a coil spring such as a valve spring and a suspension spring or to a spring made of round bar such as a stabilizer and a torsion bar as disclosed in the above patent documents. The development of the spring steel for use in a leaf spring has hardly been conducted.

Therefore, the conventional spring steel has not had an optimal component system that will lead to the solution of the problems which are not remarkable for the spring made of round bar but particularly remarkable for the leaf springs.

Recently, an attempt is made to improve fatigue strength of the leaf springs in which shot peening is performed at a temperature in the range, for example, from 150 to 350° C. with a bending stress being applied to the springs by adding a bending strain (hereinafter, this treatment is referred to as "high-strength shot peening" appropriately). It is found that although the high-strength shot peening treatment is effective in improving the fatigue strength of the leaf springs, fatigue testing on the leaf springs subjected to the treatment revealed that this treatment is not effective in obtaining sufficiently improvements in fatigue life for some leaf springs.

Further, it is required to consider the fact that decarburization tends to be observed in the final product of the leaf spring. This is caused from the fact that the leaf spring is cooled after rolling at a low rate and has a small cross sectional-area decreasing rate as a result of rolling in comparison to the spring made of round bar, such as bar steel, a wire rod, etc., since the leaf spring has a significantly large cross sectional area in its final product as compared to the spring made of a round bar.

Moreover, as to the leaf springs, it is required to solve the common problems with the springs made of round bar, such as improvements in hydrogen embrittlement resistance and toughness in the high-hardness range. Therefore, it is necessary to provide optimal steel for a leaf spring by taking into account these respects.

The present invention was made to solve these problems and an object of the present invention is to provide steel for a leaf spring with high fatigue strength that is improved in hardness for higher strength, that secures excellent toughness even in a hardness range where hydrogen embrittlement would become problem, and that allows for secure improvement in fatigue life through high-strength shot peening. Another object of the present invention is to provide a leaf spring part made of the steel for a leaf spring with high fatigue strength.

Means of Solving the Problem

The present inventors conducted dedicated study on causes for early breakage in some of the leaf springs after high-strength shot peening, and resultantly confirmed that the breakage has its fracture origin not in the surface subjected to the highest stress during fatigue testing but in an internal section, and a large bainite structure is present in the internal fracture origin. The present inventors found that the bainite structure is considered to be the cause for decrease in fatigue life. Then, the present inventors found that by actively adding Ti in a range of 0.07% through 0.15% in such a manner as to satisfy conditions of Ti/N≥10 as described later, it is possible to inhibit the occurrence of the bainite structure and, as a result, obtain excellent fatigue life stably even in a case where high-strength shot peening treatment is performed.

Further, the present inventors found a component system that is hardly likely to cause ferrite decarburization during manufacture of the leaf spring and can secure excellent characteristics even in the high hardness range, as described later. The present inventors found that leaf spring parts can be manufactured that can stably secure excellent fatigue life in the high hardness range by taking countermeasures in combination with the above-described addition of Ti and completed the present invention.

That is, the first aspect of the present invention resides in steel for a leaf spring with high fatigue strength containing, in mass percentage, C: 0.40 to 0.54%, Si: 0.40 to 0.90%, Mn: 0.40 to 1.20%, Cr: 0.70 to 1.50%, Ti: 0.070 to 0.150%, B: 0.0005 to 0.0050%, N: 0.0100% or less, and a remainder composed of Fe and impurity elements, wherein a Ti content and a N content satisfy a relation of Ti/N≥10.

The second aspect resides in steel for a leaf spring with high fatigue strength containing, in mass percentage, C: 0.40 to 0.54%, Si: 0.40 to 0.90%, Mn: 0.40 to 1.20%, Cr: 0.70 to 1.50%, Ti: 0.070 to 0.150%, B: 0.0005 to 0.0050%, and N: 0.0100% or less, further containing, in mass percentage, at least one of Cu: 0.20 to 0.50%, Ni: 0.20 to 1.00%, V: 0.05 to 0.30%, and Nb: 0.01 to 0.30%, and a remainder composed of Fe and impurity elements, wherein a Ti content and a N content satisfy a relation of Ti/N≥10.

The third aspect resides in a leaf spring part which is obtained using the steel for a leaf spring with high fatigue strength according to the first aspect or the second aspect.

Effects of the Invention

The steel for a leaf spring with high fatigue strength according to the first aspect and the steel for a leaf spring with high fatigue strength according to the second aspect have the above specific compositions.

In particular, the ranges of Ti and Ti/N are regulated as described above, so that it is possible to precipitate fine TiC and obtain fine austenite grains during heating before quenching. Accordingly, in the steel for a leaf spring, it is possible to inhibit generation of large bainite that may possibly occur during quenching and tempering. Therefore, even if the steel for a leaf spring is used to make leaf spring parts on which the high-strength shot peening treatment is performed, it is possible to prevent the occurrence of early breakage that has a large bainite as its fracture origin, thereby obtaining excellent fatigue strength.

Further, fine TiC can serve as a hydrogen trap site. Accordingly, even if hydrogen enters steel, hydrogen embrittlement hardly occurs, so that the steel for a leaf spring described above can exhibit excellent hydrogen embrittlement resistance characteristics.

Further, the above-described steel for a leaf spring is permitted to contain Si in the above-described specific range where increase in decarburization amount is not problematic while suppressing the content of C to a comparatively small level. With this arrangement, tempering softening resistance may be increased, allowing tempering to be conducted at a higher temperature. Moreover, by adding Ti and B as indispensable components, it may have high hydrogen embrittlement resistance and improved grain boundary strength.

As a result, it can exhibit excellent toughness in the high hardness range. In particular, the effects are remarkable in the high hardness range of at least HV510.

Thus, according to the first and second aspects, there is provided steel for a leaf spring with high fatigue strength that is improved in hardness for higher strength, that secures excellent toughness even in a hardness range where hydrogen embrittlement would become problem, and that allows for secure improvement in fatigue life through high-strength shot peening.

Further, the leaf spring part according to the third aspect is obtained using the steel for a leaf spring with high fatigue strength according to the first or second aspect. Specifically, the leaf spring part can be made by forming the steel for a leaf spring into a spring shape and quenching and tempering it.

Since the leaf spring part uses the steel for a leaf spring with high fatigue strength according to the first or second aspect, it can have higher hardness for higher strength and excellent toughness even in the hardness range where hydrogen embrittlement would be problematic, thereby obtaining improved fatigue life securely through high-strength shot peening.

In particular, the effects of improving toughness are remarkable in the high hardness range of at least HV510.

MODE(S) FOR CARRYING OUT THE INVENTION

Figure 1:
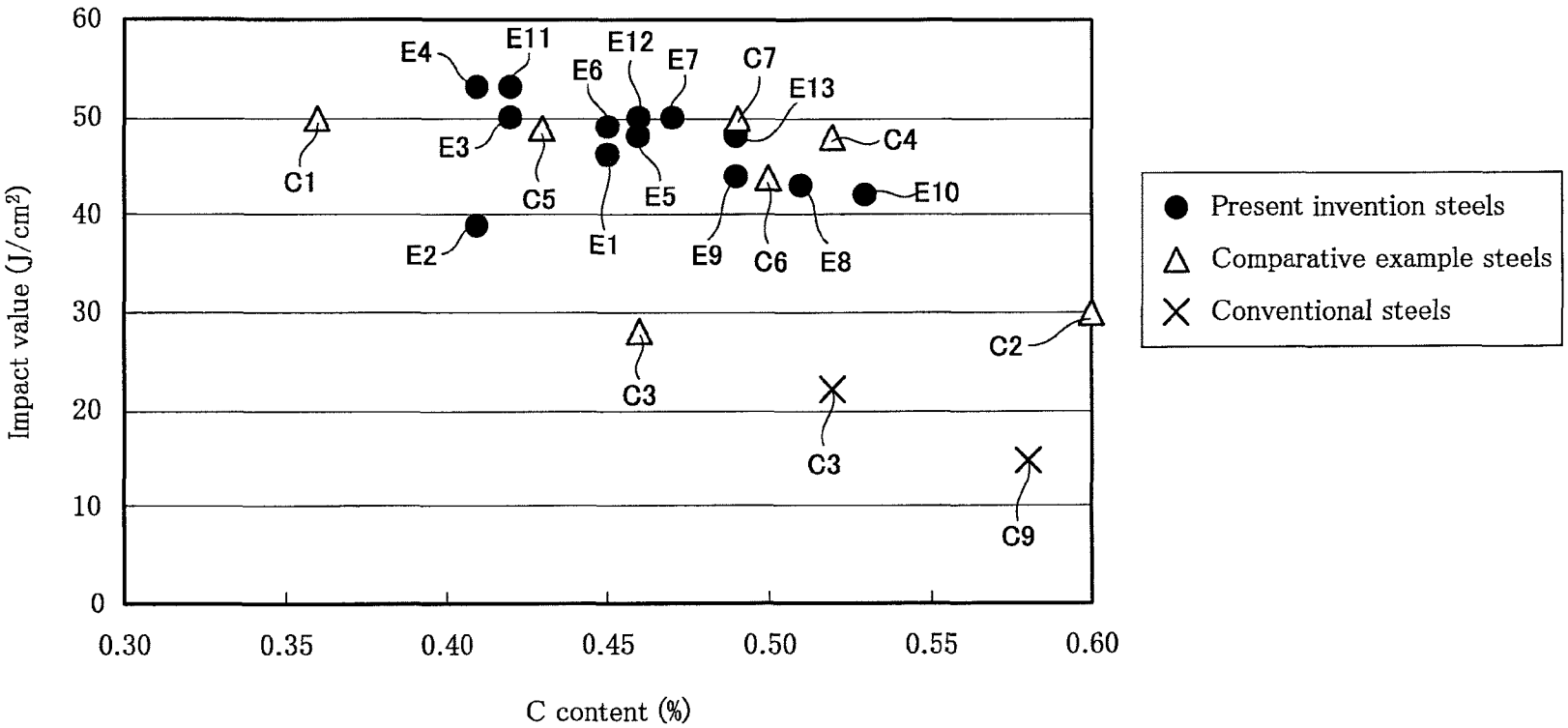
FIG. 1 is an explanatory graph of a relationship between a carbon (C) content and an impact value according to an example.

The above-described steel for a leaf spring contains C, Si, Mn, Cr, Ti, B, and N in the above-described specific composition ranges as described above.

The following will describe reasons why the content range is restricted for each of the components.

C: 0.40 to 0.54%

C is an indispensable element in order to secure sufficiently excellent strength and hardness after the quenching and tempering treatment.

If the C content is less than 0.4%, there is a possibility that the strength as a spring may be insufficient. Further, if the C content decreases, it is necessary to perform tempering at a low temperature in order to obtain high hardness, especially, hardness of at least HV510. As a result, the hydrogen embrittlement strength ratio decreases so that hydrogen embrittlement may possibly be liable to occur.

On the other hand, if the content is in excess of 0.54%, the toughness in the high hardness range tends to decrease even if Ti and B are added and hydrogen embrittlement may possibly be liable to occur. To improve toughness, in particular, it is preferable to set the upper limit to less than 0.50%.

Further, the present invention contains Ti and B while limiting the C content to the above-described specific range. Accordingly, the above-described steel for a leaf spring can have both of hardness and toughness at higher levels.

That is, in general, in the low hardness range, toughness increases as the C content decreases. However, since the spring parts according to the present invention aim at high hardness (preferably, at least HV510), if the C content is on the order of 0.40%, it becomes necessary to decrease the tempering temperature in order to obtain high hardness, resulting in a high possibility that the spring parts fall in a low-temperature tempering embrittlement range. As a result, a reversal phenomenon may occur in which toughness rather decreases as compared to a case where the C content is on the order of 0.50%. However, according to the present invention, by adding both of Ti and B as indispensable components, toughness improves in the high hardness range even if the C content is set to the order of 0.40%, which is a relatively low rate for the steel for a leaf spring, thereby improving toughness further as compared to a case where the C content is in excess of 0.54%. Especially, if the C content is set to less than 0.50%, the effects of improving toughness are remarkable.

Si: 0.40 to 0.90%

Si has effects of increasing the tempering softening resistance, to enable setting the tempering temperature to a higher value even in the case of aiming at high hardness. Accordingly, Si is an element which contributes to secure high strength and high toughness and prevents hydrogen embrittlement to improve the corrosion fatigue strength.

If the Si content is less than 0.40%, desired hardness cannot be obtained unless the tempering temperature is decreased, so that toughness cannot, possibly be improved sufficiently. Further, in such a case, there is a possibility that hydrogen embrittlement may not sufficiently be inhibited. If the content is in excess of 0.90%, the steel for a leaf spring, which has a larger cross-sectional area and a lower post-rolling cooling rate than those of a spring made of a round bar, may be liable to encounter ferrite decarburization, which may lead to deteriorations in fatigue strength.

Further, it is preferable that the Si content is in excess of 0.50% from a viewpoint of further improving the toughness.

Mn: 0.40 to 1.20%

Mn is an indispensable element in order to secure hardenability necessary as the steel for a leaf spring.

If the Mn content is less than 0.40%, there is a possibility that the hardenability necessary as the steel for a leaf spring cannot easily be obtained. If the Mn content is in excess of 1.20%, there is a possibility that the hardenability becomes excessive and quench cracks may easily occur.

Cr: 0.70 to 1.50%

Cr is an indispensable element in order to secure the hardenability necessary as the steel for a leaf spring.

If the Cr content is less than 0.70%, there is a possibility that the hardenability and tempering softening resistance necessary as the steel for a leaf spring cannot be secured. If the content is in excess of 1.50%, there is a possibility that the hardenability becomes excessive and quench cracks may easily occur.

Ti: 0.070 to 0.150%

Ti exists in steel in the form of TiC which can become a hydrogen trap site and has effects of improving hydrogen embrittlement resistance. Further, it can form fine TiC along with C in steel, allowing a quenching/tempering structure to be fined, so that the generation of large bainite structures may be inhibited. Further, it can be bound with N to form TiN to inhibit the generation of BN, thereby having effects of preventing the later-described effects from not being able to be obtained owing to the addition of B.

If the Ti content is less than 0.070%, there is a possibility that the above effects due to the addition of Ti cannot sufficiently be obtained. If the content is in excess of 0.15%, there is a possibility that TiC may easily become large.

B: 0.0005 to 0.0050%

B is an element necessary to secure the hardenability necessary as the steel for a leaf spring and has effects of improving grain boundary strength.

If the B content is less than 0.0005%, difficulty may arise in securing the hardenability necessary as the steel for a leaf spring and in improving grain boundary strength. Further, boron (B) can exhibit its effects even if only a little amount of it is contained, so that the effects are saturated if a large amount of it is contained. Therefore, the upper limit of the B content can be set to 0.0050% as described above.

N: 0.0100% or less

The above described B is easily bound with N, so that if B is bound with N contained as an impurity to form BN, there is a possibility that the effects due to B as described above cannot sufficiently be obtained. Therefore, the N content is set to 0.0100% or less.

The Ti content and the N content satisfy the relationship of $Ti/N \geq 10$. It is therefore possible to inhibit the generation of large TiN and generate fine TiC. As a result, it is possible to provide fine grains and improve fatigue strength. Further, hydrogen embrittlement resistance characteristics can be improved.

If $Ti/N < 10$, the generation of TiC is insufficient, so that there is a possibility that the grains become large to decrease fatigue strength and deteriorate hydrogen embrittlement resistance characteristics.

Further, the steel prepared to satisfy the relationships of $Ti \geq 0.07$ and $Ti/N \geq 10$ as in the later-described examples is capable of significantly inhibiting decrease in strength owing to hydrogen charge.

The steel for a leaf spring according to the first aspect contains C, Si, Mn, Cr, Ti, B, and N in the above-described specific composition ranges and a remainder composed of Fe and impurity elements as described above.

The steel for a leaf spring according to the second aspect contains C, Si, Mn, Cr, Ti, B, and N in the above-described specific amount similar to the first aspect of the steel and further contains, in mass percentage, at least one of Cu: 0.20 to 0.50%, Ni: 0.20 to 1.00%, V: 0.05 to 0.30%, and Nb: 0.01 to 0.30% and a remainder composed of Fe and impurity elements.

If the steel thus contains at least one of Cu, Ni, V, and Nb in the above specific content, it is possible to further improve toughness and corrosion resistance in the hardness range.

The following will describe reasons why the content range is restricted for each of Cu, Ni, V, and Nb.

Cu and Ni have effects to inhibit growth of corrosion pits which occur in the corrosive environment and improve the corrosion resistance.

If the Cu and Ni contents are each less than 0.20%, there is a possibility that effects of improvements in corrosion resistance owing to the addition of those elements cannot sufficiently be obtained. Further, if Cu is contained a lot, there is a possibility that the effects of improving corrosion resistance are saturated and hot workability worsens, so that the upper limit of the Cu content is preferably 0.50%. Further, even if Ni is contained a lot, the corrosion resistance effects are saturated and costs are increased, so that the upper limit of the N content is preferably 1.00%.

Further, V and Nb have effects to refine quenching and tempering structures and improve strength and toughness in a balanced manner.

If the V content is less than 0.05% or the Nb content is less than 0.01%, there is a possibility that the grain miniaturization effects owing to addition of those elements cannot sufficiently be obtained. Further, even if V and Nb are contained a lot, the toughness effects are saturated and the costs increase, so that the upper limits of the contents of V and Nb are each preferably 0.30%.

The above-described steel for a leaf spring may contain Al, as impurities, of an amount (about 0.040% or less) necessary in deoxidization processing, which is an indispensable process in manufacturing of steel.

The above-described leaf spring parts can be made by forming the above-described steel for a leaf spring and quenching and tempering it. It is thus possible to provide tempered martensite structures.

Further, the leaf spring parts preferably undergo shot peening treatment at a temperature range of the room temperature to 400° C. with a bending stress of 650 to 1900 MPa being applied to them.

That is, those leaf spring parts have preferably undergone high-strength shot peening. In this case, excellent fatigue strength can be exhibited.

Further, those leaf spring parts preferably have a Vickers hardness of at least 510.

If applied for use in high-hardness leaf spring parts, the steel for a leaf spring of the present invention can have excellent toughness and fatigue strength, which actions and effects are remarkable in a high hardness range of this Vickers hardness of at least 510.

The Vickers hardness can be adjusted to this value of at least 510 by, for example, suppressing the temperature of tempering after quenching to a low value.

EXAMPLES

Example 1

The present example will be described with respect to an example and comparative examples of the above-described steel for a leaf spring.

First, a plurality of kinds of steel for a leaf spring having chemical compositions shown in Table 1 (samples E1 through E13 and samples C1 through C10) were prepared. Cu and Ni in the compositions in Table 1 are shown in terms of content as impurities in some cases.

Out of the samples of the steel for a leaf spring shown in Table 1, the samples E1 through E13 are prepared according to the present invention, the samples C1 through C7 are prepared as comparative samples of the steel whose contents of C, Si, Ti, TiN, etc. are different in part from those of the present invention, the sample C8 is the conventional steel SUP10, the sample C9 is the conventional steel SUP11A, and the sample C10 is the conventional steel SUP6.

TABLE 1

| Sample No. | C | Si | Mn | Cr | Ti | B | N | Ti/N | Cu | Ni | V | Nb |
|---|---|---|---|---|---|---|---|---|---|---|---|---|
| E1 | 0.45 | 0.51 | 0.90 | 1.05 | 0.100 | 0.0020 | 0.0070 | 14.3 | 0.05 | 0.06 | — | — |
| E2 | 0.41 | 0.43 | 0.95 | 0.90 | 0.130 | 0.0018 | 0.0063 | 20.6 | 0.06 | 0.03 | — | — |
| E3 | 0.42 | 0.53 | 0.74 | 1.21 | 0.080 | 0.0023 | 0.0077 | 10.4 | 0.10 | 0.05 | — | — |
| E4 | 0.41 | 0.82 | 0.48 | 1.33 | 0.090 | 0.0015 | 0.0054 | 16.7 | 0.08 | 0.04 | — | — |
| E5 | 0.46 | 0.52 | 0.88 | 0.93 | 0.110 | 0.0010 | 0.0072 | 15.3 | 0.05 | 0.02 | — | — |
| E6 | 0.45 | 0.56 | 0.95 | 0.82 | 0.140 | 0.0023 | 0.0081 | 17.3 | 0.02 | 0.02 | — | — |
| E7 | 0.47 | 0.75 | 1.10 | 0.77 | 0.130 | 0.0032 | 0.0091 | 14.3 | 0.12 | 0.06 | — | — |
| E8 | 0.51 | 0.53 | 0.67 | 1.12 | 0.080 | 0.0023 | 0.0069 | 11.6 | 0.31 | 0.04 | — | — |
| E9 | 0.49 | 0.61 | 0.82 | 0.87 | 0.100 | 0.0019 | 0.0059 | 16.9 | 0.08 | 0.51 | — | — |
| E10 | 0.53 | 0.68 | 1.02 | 0.99 | 0.110 | 0.0027 | 0.0070 | 15.7 | 0.25 | 0.35 | — | — |
| E11 | 0.42 | 0.77 | 0.93 | 0.92 | 0.090 | 0.0013 | 0.0081 | 11.1 | 0.06 | 0.45 | — | — |
| E12 | 0.46 | 0.57 | 0.87 | 0.98 | 0.100 | 0.0008 | 0.0048 | 20.8 | 0.41 | 0.80 | 0.17 | — |
| E13 | 0.49 | 0.52 | 0.73 | 1.31 | 0.130 | 0.0021 | 0.0088 | 14.8 | 0.04 | 0.53 | 0.23 | 0.11 |
| C1 | 0.36 | 0.53 | 0.85 | 1.20 | 0.110 | 0.0019 | 0.0073 | 15.1 | 0.04 | 0.01 | — | — |
| C2 | 0.60 | 0.62 | 0.92 | 0.95 | 0.090 | 0.0020 | 0.0078 | 11.5 | 0.05 | 0.02 | — | — |
| C3 | 0.46 | 0.34 | 0.63 | 0.99 | 0.085 | 0.0015 | 0.0063 | 13.5 | 0.03 | 0.02 | — | — |
| C4 | 0.52 | 1.02 | 1.12 | 0.88 | 0.120 | 0.0025 | 0.0072 | 16.7 | 0.07 | 0.04 | — | — |
| C5 | 0.43 | 0.52 | 0.53 | 1.32 | 0.05 | 0.0028 | 0.0048 | 10.4 | 0.10 | 0.03 | — | — |
| C6 | 0.50 | 0.55 | 0.80 | 0.95 | 0.18 | 0.0019 | 0.0076 | 23.7 | 0.07 | 0.05 | — | — |
| C7 | 0.49 | 0.67 | 0.98 | 1.01 | 0.075 | 0.0022 | 0.0097 | 7.7 | 0.06 | 0.03 | — | — |
| C8 | 0.52 | 0.25 | 0.86 | 0.95 | 0.003 | — | 0.0072 | 0.4 | 0.04 | 0.03 | 0.17 | — |
| C9 | 0.58 | 0.24 | 0.89 | 0.84 | 0.040 | 0.0022 | 0.0066 | 6.1 | 0.05 | 0.02 | — | — |
| C10 | 0.58 | 1.72 | 0.85 | 0.12 | 0.002 | — | 0.0061 | 0.3 | 0.07 | 0.04 | — | — |

The steel materials having the compositions shown in Table 1 were provided as the later-described testing materials by melting and casting them into ingots with a vacuum induction melting furnace, extend-forging the obtained steel ingots into round bars having a diameter of 18 mm, and normalizing them. Further, in a test conducted on it having the same shape as an actual leaf spring, this steel ingot was rolled to billet, hot-rolled to a width of 70 mm and a thickness of 20 mm, and subjected to normalization to prepare a test piece.

The thus obtained round bars and flat bars were used to make test pieces (round bar test pieces or flat bar test pieces) to be used in the later-described evaluation tests and evaluations were conducted using the test pieces. Specifically, the round bars underwent the later-described impact test, decarburization test, prior austenite grain diameter measurement, and hydrogen embrittlement characteristics test, while the flat bars underwent the later-described rolled material decarburization test, fatigue test, and corrosion resistance evaluation.

Next, a description will be given on evaluations methods.

<Impact Test>

U-notch test pieces were made of the above-described round bar and underwent quenching and tempering by adjusting the tempering temperature taking into account a difference in tempering softening resistance owing to a difference in composition (the following "quenching and tempering" is performed in the same manner) so that they may have a target hardness of HV540 (Vickers hardness), providing a tempered martensite structure. Then, the impact test was conducted at the room temperature.

Impact values were measured for the thus obtained samples (samples E1 to E13, and samples C1 to C10). The results are shown in Table 2.

Figure 2:
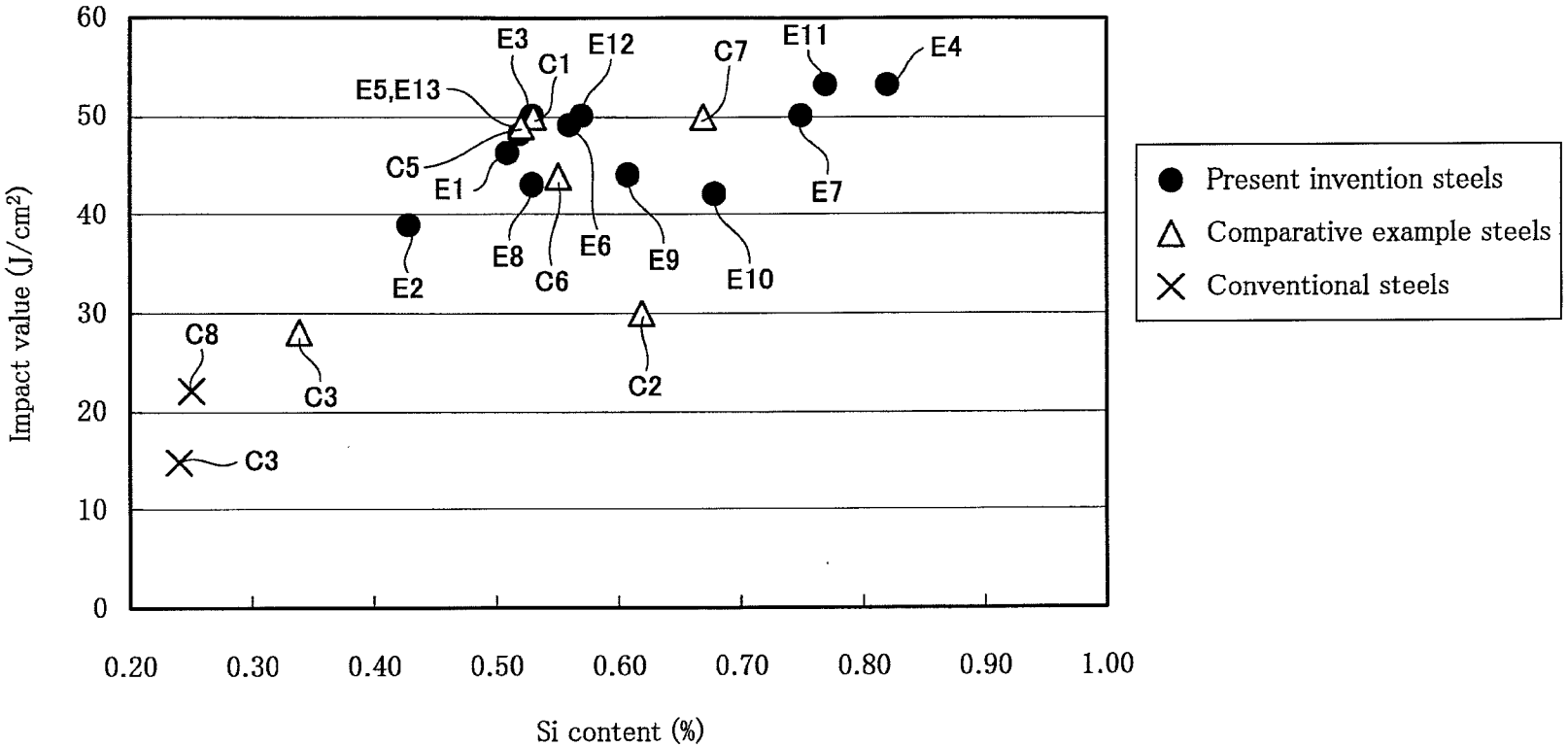
FIG. 2 is an explanatory graph of a relationship between a silicon (Si) content and an impact value according to the example.

Further, a relationship between the carbon (C) content and the impact value and that between the silicon (Si) content and the impact value were plotted in a graph. The relationship between the C content and the impact value is shown in FIG. 1 and the relationship between the Si content and the impact value is shown in FIG. 2.

<Decarburization Test>

First, the round bar with a diameter of 18 mm was cut into cylinder-shaped test pieces with a diameter of 8 mm and a height of 12 mm (decarburization amount before testing is zero (0)). Subsequently, the cylinder-shaped test pieces were heated in vacuum at a temperature increase rate of 900° C./m and held at a temperature of 900° C. for five minutes. Then, in the atmosphere, they were cooled at the same cooling rate with the cooling rate in a cooling curve, at which the aforementioned flat bars were cooled after hot rolling when they were made and which was measured beforehand. Subsequently, the test pieces were cut and polished and etched using nital. Then, the surface layer decarburization depth (DM-F) was measured with an optical microscope. The results are shown in Table 2.

Figure 3:
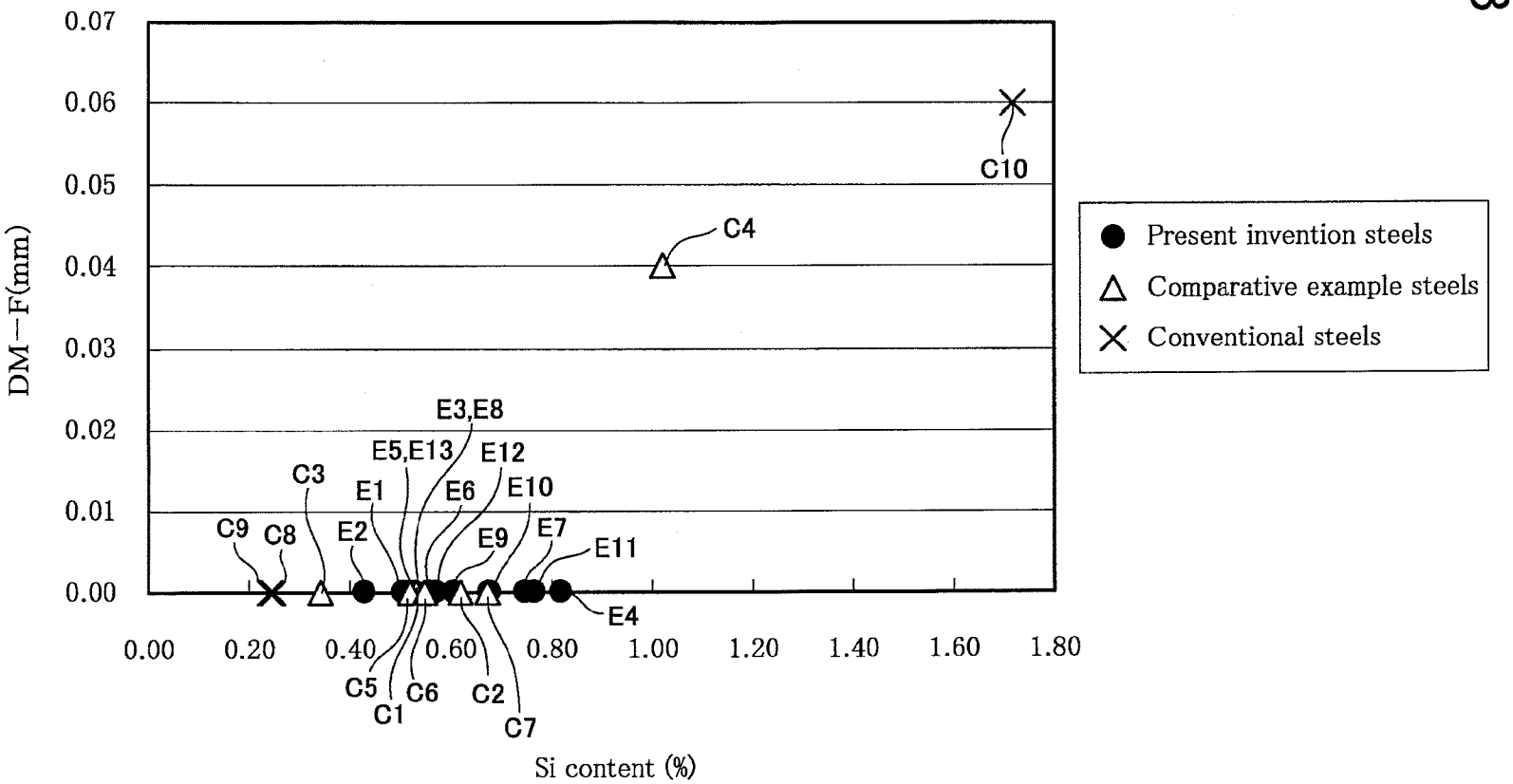
FIG. 3 is an explanatory graph of a relationship between a silicon (Si) content and a decarburization depth according to the example.

Further, a relationship between the silicon (S) content and the decarburization depth were plotted in a graph. It is shown in FIG. 3.

<Prior Austenite Grain Diameter Measurement>

The round bar test pieces having a size of 18 mm (diameter)×30 mm were heated at 950° C. and oil-quenched to provide a martensite structure. Subsequently, the test pieces were cut and polished and then immersed in picric acid solution to expose a prior austenite grain boundary so that the grain diameter (priory grain diameter) was measured with an optical microscope. The results are shown in Table 2.

Figure 4:
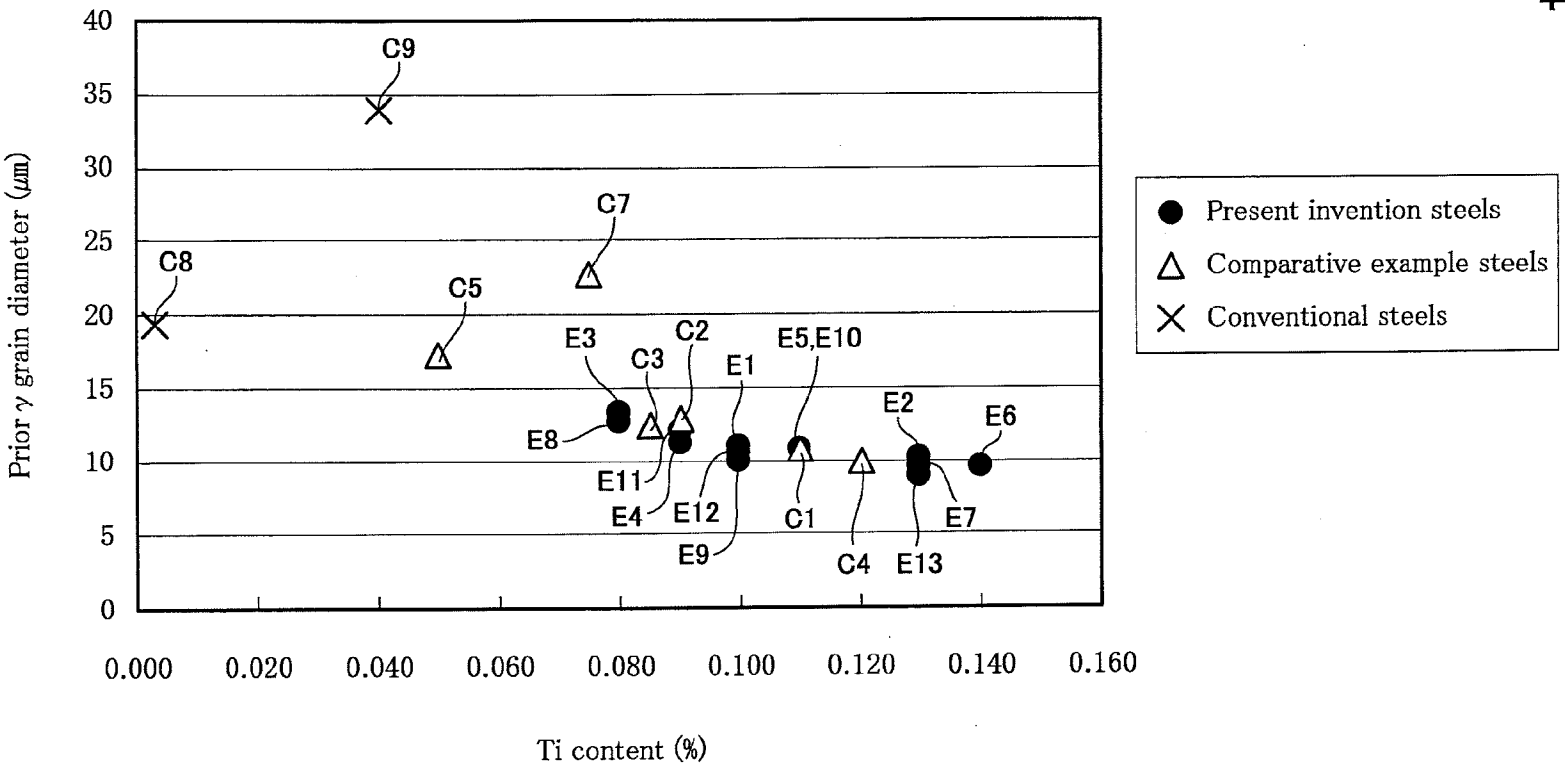
FIG. 4 is an explanatory graph of a relationship between a titanium (Ti) content and a priory γ grain diameter according to the example.
Figure 5:
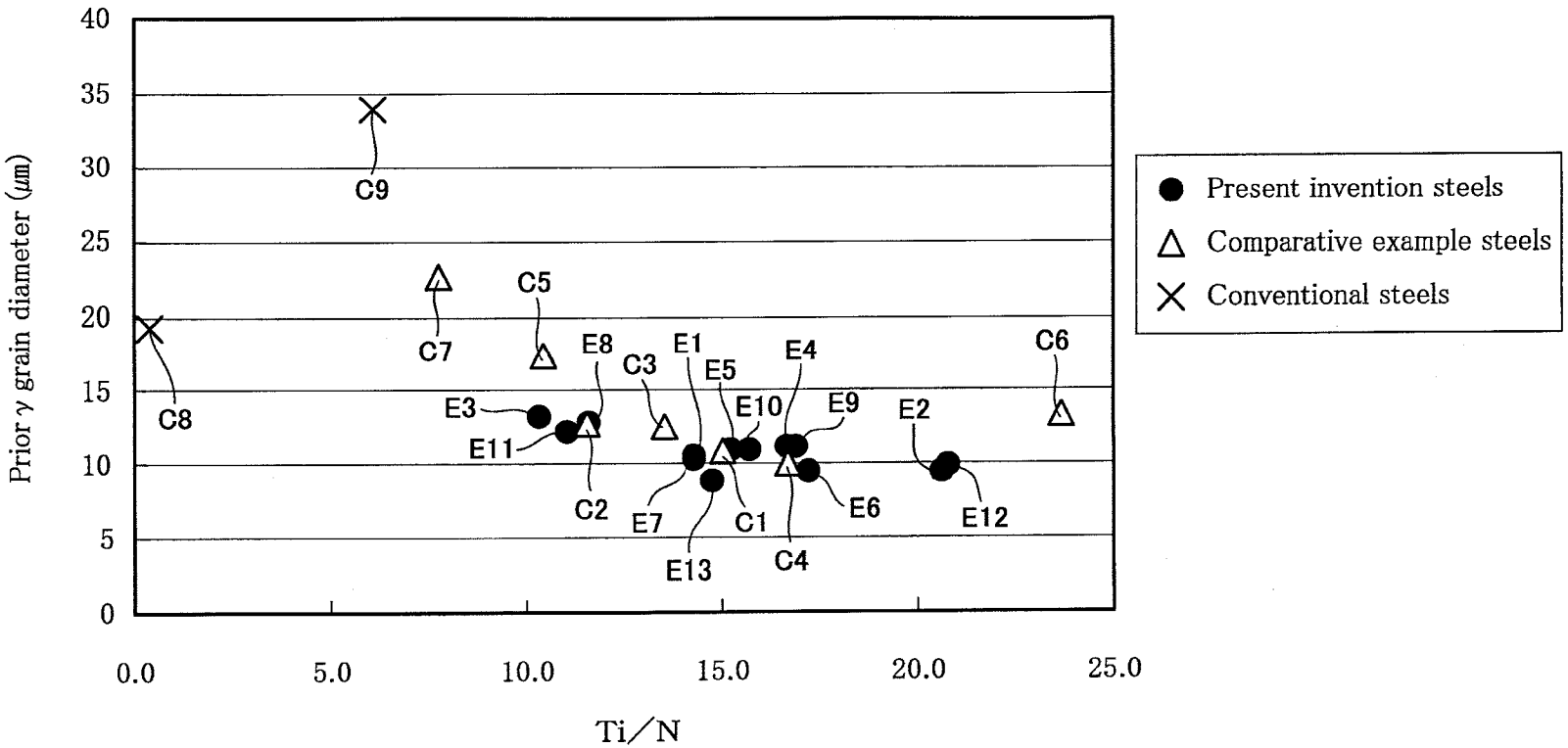
FIG. 5 is an explanatory graph of a relationship between a Ti/N rate and a prior γ grain diameter according to the example.

Further, a relationship between the titanium (Ti) content and the prior γ grain diameter and a relationship between the Ti/N rate and the prior γ grain diameter were plotted in graphs. The relationship between the Ti content and the prior γ grain diameter is shown in FIG. 4 and the relationship between the Ti/N rate and the prior γ grain diameter is shown in FIG. 5.

<Hydrogen Embrittlement Characteristics Test>

An annular notch with a depth of 1 mm was added to the parallel section of the cylinder-shaped test piece (8 mm (diameter)×75 mm) to make a round bar test piece, which underwent quenching and tempering so that it might have a target hardness of HV540 (Vickers hardness), to provide a tempered martensite structure. Subsequently, the test piece was immersed in 5 weight-percent thiocyanic acid ammonium solution (temperature of 50° C.) for 30 minutes to perform hydrogen charging. Subsequently, the test piece was taken out of the solution and, five minutes later, underwent a tensile test.

The tensile test was conducted under the condition of a strain rate of $2\times10^{-5}$/s and evaluated for a breaking load. For comparison, a test piece on which hydrogen charging was not performed was also underwent almost the same test.

Each test piece was measured in term of breaking load ($W_A$) in a case where hydrogen charging was performed and breaking load ($W_B$) in a case where hydrogen charging was not performed, to calculate the hydrogen embrittlement strength ratio (W) by using $W=W_A/W_B$. The results are shown in Table 2.

Figure 6:
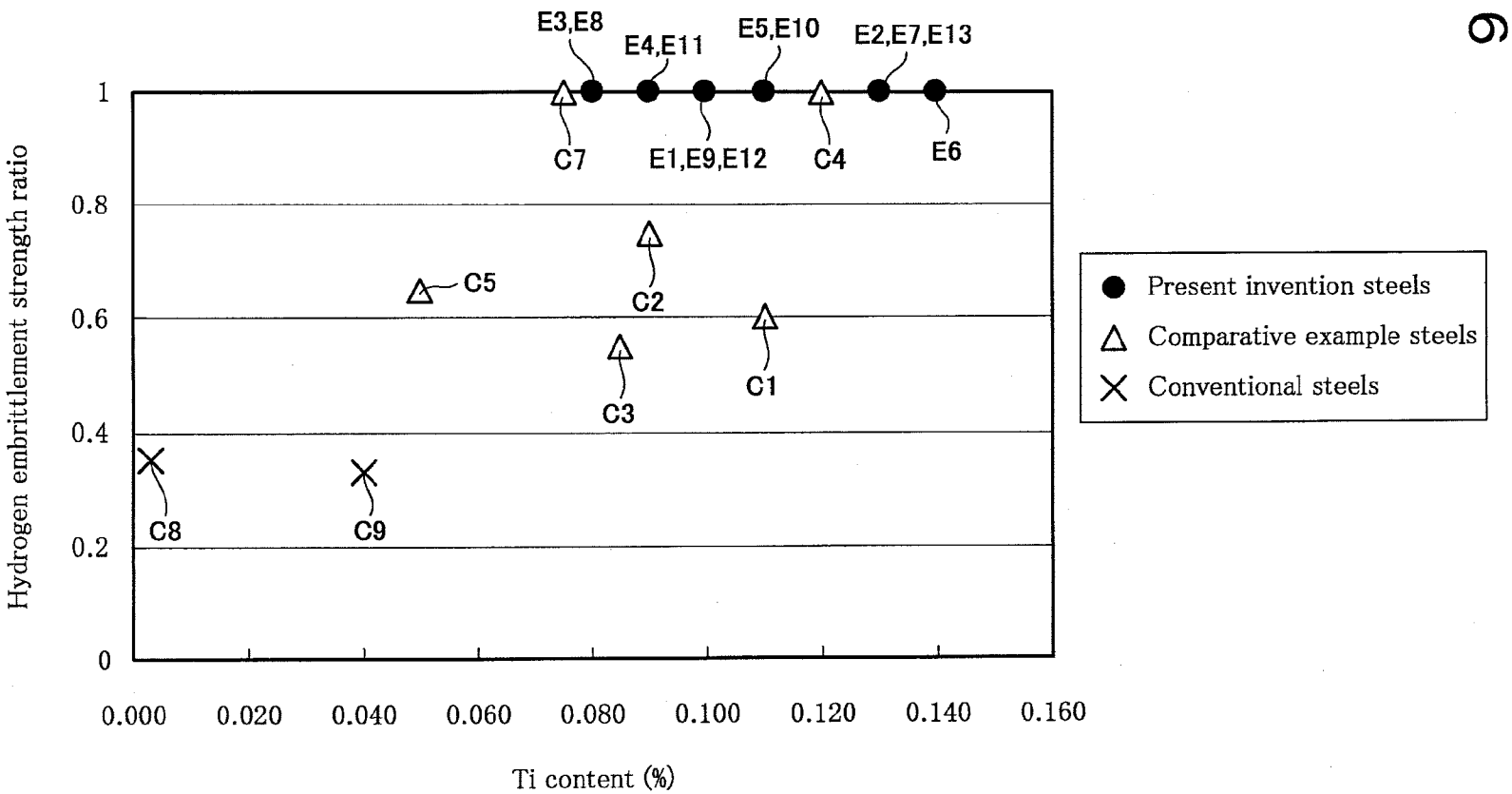
FIG. 6 is an explanatory graph of a relationship between a titanium (Ti) content and a hydrogen embrittlement strength ratio according to the example.
Figure 7:
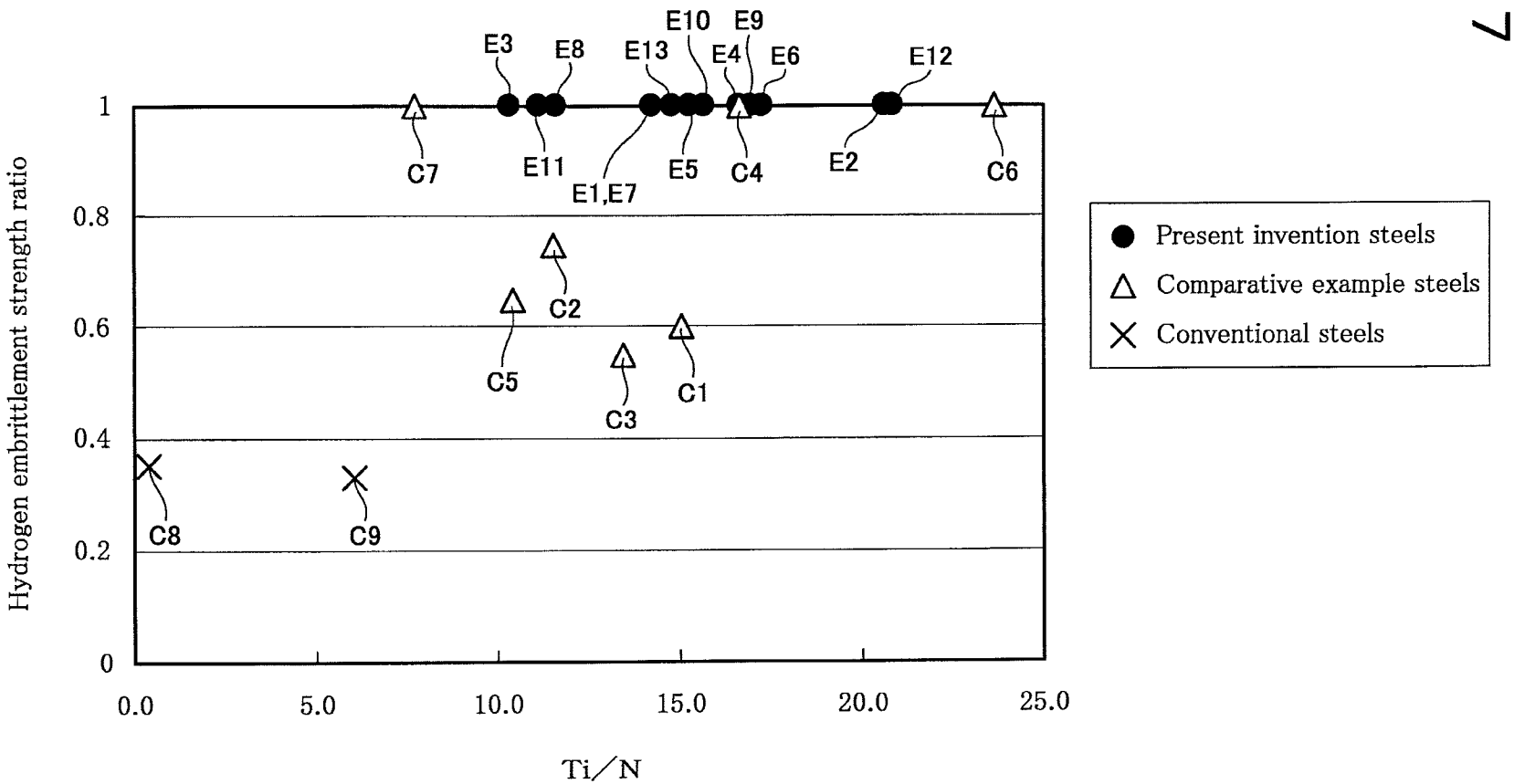
FIG. 7 is an explanatory graph of a relationship between a Ti/N rate and a hydrogen embrittlement strength ratio according to the example.

Further, a relationship between the titanium (Ti) content and the hydrogen embrittlement strength ratio and a relationship between the Ti/N rate and the hydrogen embrittlement strength ratio were plotted in graphs. The relationship between the Ti content and the hydrogen embrittlement strength ratio is shown in FIG. 6 and the relationship between the Ti/N rate and the hydrogen embrittlement strength ratio is shown in FIG. 7.

<Rolled Bar Decarburization Test>

A rolled bar with a size of 70 mm (width)×20 mm (thickness) made by rolling was cut at a cross section perpendicular to the longitudinal direction and measured for its decarburization depth (DM-F) using an optical microscope. The results are shown in Table 2. Further, to make clear an influence of a difference in shape and cross sectional area from the flat bar on the decarburization depth, the same steel ingot as that used to make the flat bar was rolled to make a round bar with a diameter of 12 mm, which was similarly cut at a cross section and measured for its decarburization depth (DM-F). The results are shown in Table 2.

<Fatigue Test>

The rolled bar with the size of 70 mm (width)×20 mm (thickness) made by hot rolling was formed into the shape of a leaf spring. Subsequently, it underwent quenching and tempering so that it might have a target hardness of HV540 (Vickers hardness) to provide a tempered martensite structure and then underwent high-strength shot peening. High-strength shot peening was performed at a bending stress of 1400 MPa and at a temperature of 300° C. The leaf spring parts thus obtained from each sample by performing shot peening on it underwent a fatigue test until it breaks at a stress of 760±600 MPa, to measure its rupture life and fracture origin.

The fatigue life was measured in terms of the number of times the test was repeated until failure occurs, so that if the number of times exceeded 400,000, "○" was given as evaluation and if it was less than 400,000, "x" was given as evaluation. The results are shown in Table 2. Further, the fracture surface was observed to check the fracture origin. If the fracture origin existed on the surface, "SURFACE" was given and, if it existed inside, "INSIDE" was given in the results shown in Table 2. Moreover, in a case where the fracture origin was inside, confirmation was made as to whether the fracture origin was in a large structure or in an inclusion using a microscope. The results are shown in Table 2.

<Corrosion Resistance Evaluation>

The rolled bar with the size of 70 mm (width)×20 mm (thickness) made by rolling underwent quenching and tempering to provide a martensite structure and cut into plate-shaped test pieces having a width of 30 mm×a thickness of 8 mm×a length of 100 mm. Subsequently, the plate-shaped test pieces were sprayed with sodium chloride solution (salt water) with a concentration of 5 weight percent at a temperature of 35° C. for two hours (salt water spray processing), dried using hot air of 60° C. for four hours (dry processing), and also moistened at a temperature of 50° C. and a humidity of at least 95% for two hours (moistening processing). One cycle of the salt water spray processing, the dry processing, and the moistening processing was repeated by 60 cycles. Then, a corrosive product generated on the surface of the test piece was removed to measure the maximum corrosion pit depth emerging on the cross-sectional surface of the corroded portions with an optical microscope. The results are shown in Table 2.

valve spring having a diameter of 10 to 20 mm, encounters a decrease in fatigue strength owing to decarburization when used in a leaf spring.

Further, it is found that the sample C5 having a too low content of Ti deteriorates in hydrogen embrittlement characteristics. Moreover, the sample C5 has an increased prior γ grain diameter and is liable to breakage in its internal large structure, thus causing deterioration in fatigue. The sample C6 having a too high content of Ti has an inclusion which occurs in its internal structure and is liable to be ruptured at the inclusion, thus causing deterioration in fatigue similarly.

Further, the sample C7 having a too low Ti/N rate has an increased prior γ grain diameter and is liable to breakage in its internal large structure, thus causing deterioration in fatigue.

Further, the conventional steel samples C8 and C9 have a low impact value and poor toughness in a case where their hardness was increased as in the case of the present example. They exhibited low hydrogen embrittlement characteristics, and have a large prior γ grain diameter so that breakage might be liable to occur at the internal large structure, thus causing deterioration in fatigue. Further, the conventional steel sample C10 had an increased ferrite decarburization amount.

TABLE 2

| Sample No. | Impact value ($J/cm^2$) | Depth of decarburization of a round bar (mm) | Prior γ grain diameter (μm) | Hydrogen embrittlement strength ratio | Decarburization depth of a rolled material (mm) flat bar (70 mm × 20 mm) | Decarburization depth of a rolled material (mm) round bar (ϕ12) | Fatigue test for a leaf spring | Fracture origin | Corrosion pit depth (μm) |
|---|---|---|---|---|---|---|---|---|---|
| E1 | 46 | 0 | 10.5 | 1 | 0 | 0 | ○ | SURFACE | 120 |
| E2 | 40 | 0 | 9.4 | 1 | — | — | — | — | — |
| E3 | 50 | 0 | 13.2 | 1 | — | — | — | — | — |
| E4 | 53 | 0 | 11.2 | 1 | 0 | 0 | ○ | SURFACE | 123 |
| E5 | 48 | 0 | 10.8 | 1 | — | — | — | — | — |
| E6 | 49 | 0 | 9.5 | 1 | — | — | — | — | — |
| E7 | 50 | 0 | 10.2 | 1 | 0 | — | ○ | SURFACE | 125 |
| E8 | 43 | 0 | 12.7 | 1 | — | — | — | — | — |
| E9 | 44 | 0 | 11 | 1 | — | — | — | — | — |
| E10 | 41 | 0 | 10.8 | 1 | 0 | — | ○ | SURFACE | 63 |
| E11 | 53 | 0 | 12.1 | 1 | 0 | — | ○ | SURFACE | 88 |
| E12 | 50 | 0 | 9.9 | 1 | — | — | — | — | — |
| E13 | 48 | 0 | 8.8 | 1 | — | — | — | — | — |
| C1 | 50 | 0 | 10.8 | 0.6 | — | — | — | — | — |
| C2 | 30 | 0 | 12.8 | 0.75 | — | — | — | — | — |
| C3 | 28 | 0 | 12.5 | 0.55 | — | — | — | — | — |
| C4 | 48 | 0.04 | 10 | 1 | 0.03 | 0 | X | SURFACE | 140 |
| C5 | 49 | 0 | 17.3 | 0.65 | 0 | — | X | INSIDE (large structure) | 119 |
| C6 | 44 | 0 | 13.4 | 1 | 0 | — | X | INSIDE (inclusion) | 124 |
| C7 | 50 | 0 | 22.7 | 1 | 0 | — | X | INSIDE (large structure) | 133 |
| C8 | 22 | 0 | 19.3 | 0.35 | 0 | — | X | INSIDE (large structure) | 154 |
| C9 | 15 | 0 | 34 | 0.33 | 0 | — | X | INSIDE (large structure) | 172 |
| C10 | — | 0.06 | — | — | 0.05 | — | — | — | — |

As may be seen from Table 2 and FIGS. 1 to 7, the sample C1 having a too low content of C and the sample C3 having a too low content of Si need to lower the tempering temperature in order to secure the hardness of HV540 and resultantly are liable to encounter hydrogen embrittlement. Further, the sample C2 having a too high content of C deteriorates not only in hydrogen embrittlement characteristics but also in toughness.

The sample C4 having a too high content of Si has an increased ferrite decarburization amount and a dropped fatigue life. For comparison, there is shown also the decarburization depth of the round bar with a diameter of 12 mm corresponding to the shape and dimensions of a car coil spring, and no ferrite decarburization was confirmed despite the high content of Si. From those results, it is found that there is a high possibility that a high silicon content steel, which is not problematic when used in a car coil spring or a thinner In contrast, the samples E1 through E12 of the present invention was not liable to encounter rupture at the internal fracture origin, excellent in fatigue, and could have excellent fatigue strength even if shot peening (that is, high-strength shot peening) was performed on them at a temperature higher than the room temperature with a bending stress being applied to them. Further, they were excellent in hydrogen embrittlement characteristics and not easily embrittled even if hydrogen entered the steel. Moreover, they had strength and toughness in a balanced manner and good fatigue strength. Accordingly, they can be well suitably used as the steel for leaf springs of automobiles such as trucks, for example.

Further, although the lower limit of the content of Si is set to 0.40% in the present invention, as may be seen from Table 2 and FIG. 2, it is preferable to increase the content of Si above 0.50% in order to improve toughness more by increasing the impact value in the high hardness range.

As described above, it is found that as the material for the leaf spring parts having a high hardness of, for example, Vickers hardness of 510 or higher, the steel for a leaf spring is well suited which contains, in mass percentage, C: 0.40 to 0.54%, Si: 0.40 to 0.90%, Mn: 0.40 to 1.20%, Cr: 0.70 to 1.50%, Ti: 0.070 to 0.150%, B: 0.0005 to 0.0050%, N: 0.0100% or less, and a remainder composed of Fe and impurity elements, wherein a Ti content and a N content satisfy a relation of Ti/N≥10 (samples E1 to E13). By employing such steel for a leaf spring, it is possible to provide leaf spring parts that are improved in hardness for higher strength, that secure excellent toughness even in a hardness range where hydrogen embrittlement would become problem, and that are securely improved in fatigue life through high-strength shot peening.

Example 2

In contrast to example 1 where HV540 was the target hardness, in the present example, an impact test was conducted on a test piece having different target hardness and a relationship between the hardness and the impact value was checked.

Figure 8:
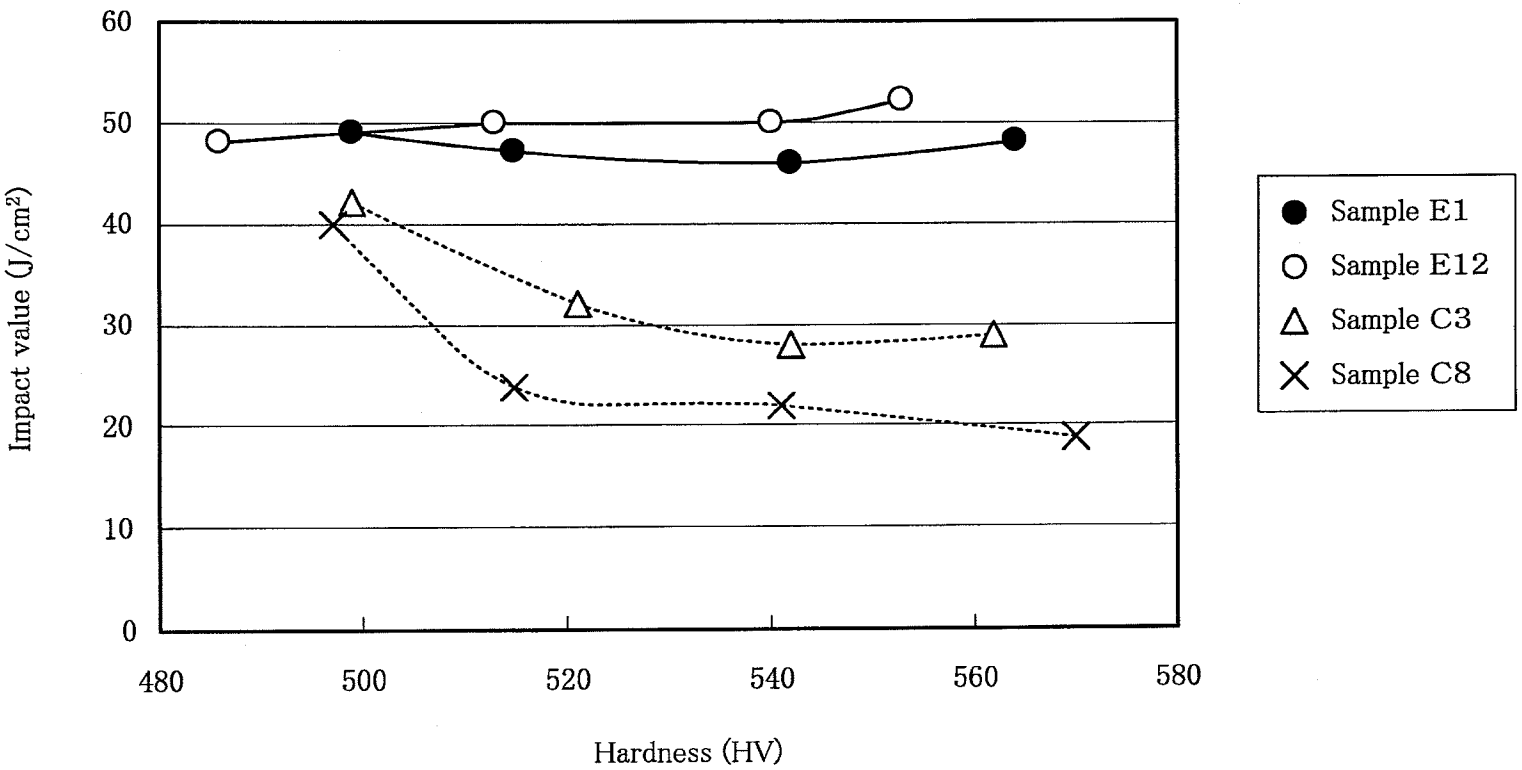
FIG. 8 is an explanatory graph of a relationship between hardness and an impact value.

That is, the samples E1, E12, C3, and C8 of example 1 underwent quenching and tempering to make test pieces in condition that the target hardness was changed, and the impact test similar to that in example 1 was conducted for them. The results are shown in Table 3 and FIG. 8. In FIG. 8, the horizontal axis indicates Vickers hardness (HV) of each sample and the vertical axis indicates an impact value of each sample, and a relationship between the hardness and the impact value is indicated.

TABLE 3

| Sample No. | Vickers hardness | Impact value |
|---|---|---|
| E1 | 564 | 48 |
| | 542 | 46 |
| | 515 | 47 |
| | 499 | 49 |
| E12 | 553 | 52 |
| | 540 | 50 |
| | 513 | 50 |
| | 486 | 48 |
| C3 | 562 | 29 |
| | 542 | 28 |
| | 521 | 32 |
| | 499 | 42 |
| C8 | 570 | 19 |
| | 541 | 22 |
| | 515 | 24 |
| | 497 | 40 |

Table 3 and FIG. 8 show that the sample C3 and the conventional steel SUP10 sample C8 having a low content of Si have decreased impact values and deteriorated toughness as the hardness increases.

In contrast, the samples E1 and E12 within a composition range of the present invention exhibit strength and toughness, keeping high impact values even if the hardness is increased.

For example, truck leaf springs are significantly heavy parts as compared to other parts, so that technologies for their weight saving, if developed, may have large effects. To enhance the weight saving effects, mere improvements only in toughness and hydrogen embrittlement resistance in the high hardness range are not enough, but it has been necessary to develop a material that allows for enhanced effects due to shot peening performed at a temperature higher than the room temperature with a bending stress being applied, that is, high-strength shot peening. The present invention completely satisfies the needs and is expected to have the large effects.

The invention claimed is:

1. Steel for a leaf spring with high fatigue strength containing, in mass percentage:

C: 0.40 to 0.54%, Si: 0.40 to 0.90%, Mn: 0.40 to 1.20%, Cr: 0.70 to 1.50%, Ti: 0.070 to 0.150%, B: 0.0005 to 0.0050%, N: 0.0100% or less, and a remainder composed of Fe and impurity elements, wherein a Ti content and a N content satisfy a relation of Ti/N≥10.

2. Steel for a leaf spring with high fatigue strength containing, in mass percentage:

C: 0.40 to 0.54%, Si: 0.40 to 0.90%, Mn: 0.40 to 1.20%, Cr: 0.70 to 1.50%, Ti: 0.070 to 0.150%, B: 0.0005 to 0.0050%, and N: 0.0100% or less, further containing, in mass percentage, at least one of Cu: 0.20 to 0.50%, Ni: 0.20 to 1.00%, V: 0.05 to 0.30%, and Nb: 0.01 to 0.30%, and a remainder composed of Fe and impurity elements, wherein a Ti content and a N content satisfy a relation of Ti/N≥10.

3. A high fatigue-strength leaf spring part obtained by using the steel for a leaf spring according to claim 1.

4. The high fatigue-strength leaf spring part according to claim 3 which is subjected to a shot peening treatment in a temperature range of room temperature to 400° C. with a bending stress of 650 to 1900 MPa being applied to the leaf spring part.

5. The high fatigue-strength leaf spring part according to claim 3 has a Vickers hardness of at least 510.

6. A high fatigue-strength leaf spring part obtained by using the steel for a leaf spring according to claim 2.

7. The high fatigue-strength leaf spring part according to claim 6 which is subjected to a shot peening treatment in a temperature range of room temperature to 400° C. with a bending stress of 650 to 1900 MPa being applied to the leaf spring part.

8. The high fatigue-strength leaf spring part according to claim 4 has a Vickers hardness of at least 510.

9. The high fatigue-strength leaf spring part according to claim 6 has a Vickers hardness of at least 510.

10. The high fatigue-strength leaf spring part according to claim 7 has a Vickers hardness of at least 510.

* * * * *